US007892416B2

(12) United States Patent
Ellingsen

(10) Patent No.: US 7,892,416 B2
(45) Date of Patent: Feb. 22, 2011

(54) LOW TEMPERATURE THERMODYNAMIC CRACKING AND CONVERSION FOR UPGRADING OF HEAVY OILS

(75) Inventor: Olav Ellingsen, Florø (NO)

(73) Assignee: Ellycrack AS, Floro (NO)

( * ) Notice: Subject to any disclaimer, the term of this patent is extended or adjusted under 35 U.S.C. 154(b) by 0 days.

(21) Appl. No.: 10/597,734

(22) PCT Filed: Feb. 3, 2005

(86) PCT No.: PCT/NO2005/000040

§ 371 (c)(1),
(2), (4) Date: Apr. 26, 2007

(87) PCT Pub. No.: WO2005/078051

PCT Pub. Date: Aug. 25, 2005

(65) Prior Publication Data

US 2007/0193924 A1 Aug. 23, 2007

(30) Foreign Application Priority Data

Feb. 11, 2004 (NO) ..... 20040615

(51) Int. Cl.
*C10G 9/32* (2006.01)
*C10G 9/26* (2006.01)

(52) U.S. Cl. ..... 208/126; 208/108; 208/113; 208/158

(58) Field of Classification Search ..... 208/113, 208/126, 158, 108
See application file for complete search history.

(56) References Cited

U.S. PATENT DOCUMENTS

| | | | | |
|---|---|---|---|---|
| 2,454,466 | A * | 11/1948 | Le Roi | 502/41 |
| 4,276,150 | A | 6/1981 | McHenry, Jr. | |
| 4,708,785 | A | 11/1987 | Myers | |
| 5,234,578 | A | 8/1993 | Stine et al. | |
| 5,348,644 | A | 9/1994 | Maroy et al. | |
| 5,538,623 | A | 7/1996 | Johnson et al. | |
| 6,660,158 | B1 * | 12/2003 | Ellingsen | 208/113 |

FOREIGN PATENT DOCUMENTS

| | | |
|---|---|---|
| EP | 0 077 044 A2 | 4/1983 |
| EP | 0 101 878 A2 | 3/1984 |
| EP | 0 236 055 A2 | 9/1987 |
| GB | 754966 | 8/1956 |
| WO | WO 00/47695 | 8/2000 |

* cited by examiner

*Primary Examiner*—Prem C Singh
(74) *Attorney, Agent, or Firm*—Merchant & Gould P.C.

(57) ABSTRACT

The present invention provides a thermodynamic cracking process wherein the cracking takes place in a cyclone reactor and in a riser of varying areas under the influence of a rotating and turbulent fluidised energy carrier which is put in motion in a fluidised regenerator by injection of combustion gases or air. A cracking unit is also described.

19 Claims, 3 Drawing Sheets

LOW TEMPERATURE THERMODYNAMIC CRACKING AND CONVERSION FOR UPGRADING OF HEAVY OILS

This application is the National Stage Application of International Application No. PCT/NO2005/000040 filed on Feb. 3, 2005, which claims priority to Norwegian Application No. 20040615 filed on Feb. 11, 2004, the complete descriptions of which are hereby incorporated by reference.

The present invention is related to a low temperature thermodynamic cracking and conversion process for upgrading of heavy oil by increasing its API value.

The invention is an improvement of the invention described in U.S. Pat. No. 6,660,158.

The following general introduction to catalytic cracking highlights present status and the outlined words and sentences focus on the difficulties/precautions which have to be met from case to case.

Catalytic cracker unit (FCCU) processes are widely utilised in the petroleum industry in the upgrading of oils. The 'heart' of such processes consists of a reactor vessel and a regenerator vessel interconnected to allow the transfer of spent catalyst from the reactor to the regenerator and of regenerated catalyst back to the reactor. The oil is cracked in the reactor section by exposing it to high temperatures and in contact with the catalyst. The heat for the oil cracking is supplied by the exothermic heat of reaction generated during the catalyst regeneration. This heat is transferred by the regenerated fluid catalyst stream itself. The oil streams (feed and recycle) are introduced into this hot catalyst stream en route to the reactor. Much of the cracking occurs in the dispersed catalysed phase along this transfer line or riser.

The final contact with the catalyst bed in the reactor completes the cracking mechanism. The vaporised cracked oil from the reactor is suitably separated from entrained catalyst particles by cyclones and routed to the recovery section of the unit. Here it is fractionated by conventional means to meet the product stream requirements. The spent catalyst is routed from the reactor to the regenerator after separation from the entrained oil. Air is introduced into the regenerator and the fluid bed of the catalyst. The air reacts with the carbon coating on the catalyst to form $CO/CO_2$. The hot and essentially carbon-free catalyst completes the cycle by its return to the reactor. The flue gas leaving the regenerator is rich in CO. This stream is often routed to a specially designed steam generator where the CO is converted to $CO_2$ and the exothermic heat of reaction used for generating steam (the CO boiler). The principle difference between the present invention and this prior art, is that $CO/CO_2$ is not routed to any external boiler, but plays a vital part in the present invention.

Feedstocks to the FCCU are primarily in the heavy vacuum gas oil range. Typical boiling ranges are 340° (10%) to 525° C. (90%). This allows feedstock with final boiling point up to 900 C. This gas oil is limited in end point by maximum tolerable metals, although the new zeolite catalysts have demonstrated higher metal tolerance than the older silica-alumina catalyst. The principle difference between present invention and this option is that the present invention is not limited by its metal content as the process reduces the metal content in the order of 90%. In addition the process does not require use of an advanced catalyst, but can use an energy carrier in the form of fine grain minerals, such as inter alia silicon oxide and olivine.

The fluid catalytic cracker is usually a licensed facility. Correlations and methodology are therefore proprietary to the licensor although certain data are divulged to clients under the licensor agreement. Such data are required by clients for proper operation of the unit, and may not be divulged to third parties without the licensor's expressed permission.

These and other means, including operating instructions, are required for the proper operation of the units. Most of the proprietary data, however, concern the reactor/regenerator side of the process. The recovery side—that is, the equipment required to produce the product streams from the reactor effluent-utilises essentially conventional techniques in their design and operating evaluation.

Up to the late 1980s feedstock to FCCU were limited by characteristics such as high Conradson carbon and metals. This excluded the processing of the 'bottom of the barrel' residues. Indeed, even the processing of vacuum gas oil feeds were limited to Conradson carbon <10 wt %

Hydrogen content >11.2 wt %

Metals NI+V<50 ppm

During the late 1980s significant breakthroughs in research and development produced a catalytic process that could handle these heavy feeds and indeed some residues. Feedstocks heavier than vacuum gas oil when fed to a conventional FCCU tend to increase the production of coke and this in turn deactivates the catalyst. This is mainly the result of:

- A high portion of the feed that does not vaporise. The un-vaporised portion quickly cokes on the catalyst, choking its active area.
- The presence of high concentrations of polar molecules such as polycyclic aromatics and nitrogen compounds. These are absorbed into the catalyst's active area causing instant (but temporary) deactivation.
- Heavy metals contamination that poison the catalyst and affect the selectivity of the cracking process.
- High concentration of polynaphthenes that dealkylate slowly.

The present invention does not suffer from any of these drawbacks.

In the FCCU process conventional feedstock cracking temperature is controlled by the circulation of hot regen catalyst. With the heavier feedstock, with an increase in Conradson carbon there will be a more pronounced coke formation. This in turn produces a high regen catalyst temperature and heat load. To maintain heat balance, catalyst circulation is reduced, leading to poor or unsatisfactory performance. Catalyst cooling or feed cooling is used to overcome this high catalyst heat load and to maintain proper circulation.

In the present invention, the temperature of the energy carrier is controlled by internal cooling in the regenerator.

The extended boiling range of the feed, as in the case of residues, tends to cause an uneven cracking severity. The lighter molecules in the feed are instantly vaporised on contact with the hot catalyst and cracking occurs. In the case of the heavier molecules vaporisation is not achieved as easily. This contributes to a higher coke deposition with a higher rate of catalyst deactivation. Ideally, the whole feed should be instantly vaporised so that a uniform cracking mechanism can commence. The mix temperature (which is defined as the theoretical equilibrium temperature between the uncracked vaporised feed and the regenerated catalyst) should be close to the feed dew point temperature. In conventional units this is about 20-30' C. above the riser outlet temperature. This can be approximated by the expression:

$$T_m = T_R + 0.1\Delta AH_c$$

$T_m$=the mix temperature $T_R$=riser outlet temperature (° C.)

$\Delta Ah_c$=heat of cracking (BTU/lb or kJ/kg)

This mix temperature is also slightly dependent on the catalyst temperature.

Cracking severity is affected by polycyclic aromatics and nitrogen. This is so because these compounds tend to be absorbed into the catalyst. Raising the mix temperature by increasing the riser temperature reverses the absorption process. Unfortunately, a higher riser temperature leads to undesirable thermal cracking and production of dry gas.

The processing of heavy feedstock therefore requires special techniques to overcome:

Feed vaporisation.

High concentration of polar molecules.

Presence of metals.

Some of the techniques developed to meet heavy oil cracking processing are the following:

Two-stage regeneration.

Riser mixer design and mix temperature control (for rapid vaporisation).

New riser lift technology minimising the use of steam.

Regen catalyst temperature control (catalyst cooling).

Catalyst selection for:

Good conversion and yield pattern.

Metal resistance.

Thermal and hydrothermal resistance.

High-gasoline RON.

Figure 1:
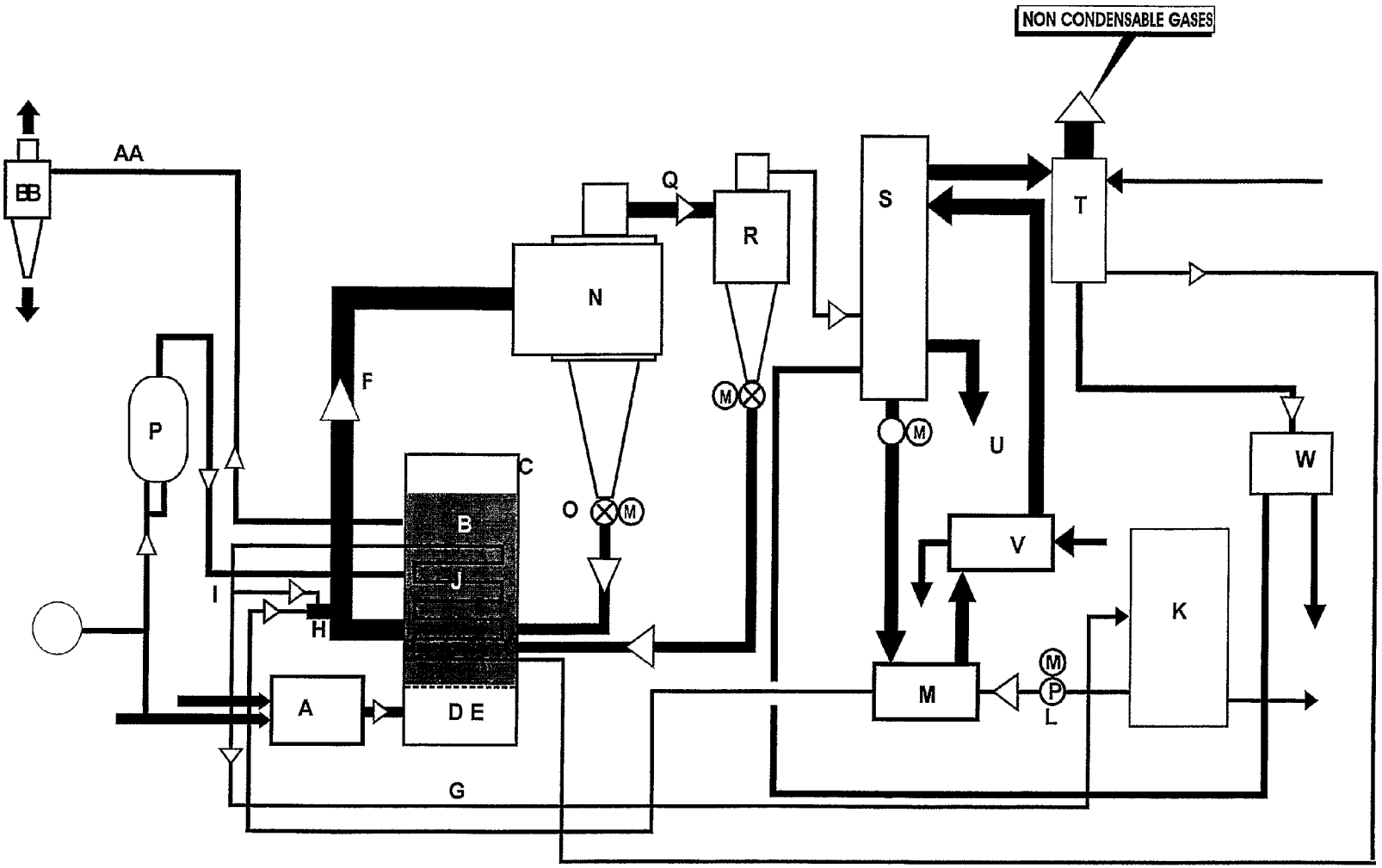
FIG. 1 is a schematic flow diagram of the process according to the invention.

The present invention will show how this is solved and demonstrate that it is not needed to use a two-stage regeneration.

An important issue in the case of heavy oil fluid catalytic cracking is the handling of the high coke deposition and the protection of the catalyst. One technique that limits the severe conditions in regeneration of the spent catalyst is a two-stage regenerator.

This differs from the present invention.

The spent catalyst from the reactor is delivered to the first regenerator. Here the catalyst undergoes a mild oxidation with a limited amount of air. Temperatures in this regenerator remain fairly low, around 700-750° C. From this first regenerator the catalyst is pneumatically conveyed to a second one. Here excess air is used to complete the carbon bum-off and temperatures up to 900° C. are experienced. The regenerated catalyst leaves this second regenerator to return to the reactor via the riser. The technology that applies to the two-stage regeneration process is innovative in that it achieves the burning off of the high coke without impairing the catalyst activity. In the first stage the conditions encourage the combustion of most of the hydrogen associated with the coke. A significant amount of the carbon is also burned off under mild conditions. These conditions inhibit catalyst deactivation.

The present invention operates with a temperature of 450-600 C in the regenerator, which is far below the temperature presented above.

It has been found that there is a specific temperature range for the energy carrier that is desirable for a given feed and catalyst system. A unique dense phase energy carrier cooling system provides a technique through which the best temperature and heat balance relationship can be maintained.

These features are a vital part of the present invention.

It is reported that 69% of the enthalpy contained in the heat input to the reactor is required just to heat and vaporise the feed. The remainder is essentially available for conversion. To improve conversion it would be very desirable to allow more of the available heat to be used for conversion. The only variable that in conventional FCCU's units can be changed to achieve this requirement is the feed inlet enthalpy, that is, through preheating the feed. Doing this, however, immediately reduces the catalyst circulation rate to maintain heat balance. This has an adverse effect on conversion. The preheating of the feed may, however, be compensated for by cooling the energy carrier. Thus the circulation rate of the energy carrier can be retained and, in many cases, increased. Indeed, by careful manipulation of the heat balance, the net increase in energy carrier circulation rate can be as high as 1 unit cat/oil ratio. The higher equilibrium activity for the energy carrier possible at the lower regeneration temperature also improves the unit yield pattern.

This is an important feature of the present invention, preheating of the oil still allows a high flow of energy carrier and oil feed as the generated CO/CO2 and steam from the atomization of the oil, dramatically reduces the partial pressure of the oil whereby the oil behaves as being evaporated under high vacuum.

In residue cracking commercial experience indicates that operations at regenerated catalyst temperatures above 900° C. result in poor yields, with high gas production due to local thermal cracking of the oil on contact. Where certain operations require high regen temperatures the installation of a catalyst cooler will have a substantial economic incentive. This will be due to improved yields and catalyst consumption.

This is also a feature of the present invention, as low partial pressure permits a low temperature of the energy carrier, which is controlled by the internal cooler in the regenerator.

The equilibrium temperature between the oil feed and the regenerated catalyst must be reached in the shortest possible time. This is required in order to ensure the rapid and homogeneous vaporisation of the feed. To ensure this it is necessary to design and install a proper feed injection system. This system should ensure that any catalyst back-mixing is eliminated and that all the vaporised feed components are subject to the same cracking severity.

This is achieved in the present invention by the atomisation nozzles and the flow pattern in the riser.

Efficient mixing of the feed finely atomized in small droplets is achieved by contact with a pre-accelerated dilute suspension of the regen catalyst. Under these conditions feed vaporisation takes place almost instantaneously. According to the present invention it is achieved that the low velocity of the energy carrier in the regenerator is accelerated before it reaches the injection site of the oil, and then retarded to a lower velocity.

Another problem encountered in heavy oil cracking is the possibility that the heavier portion of the oil is below its dew point. To ensure that this problem is overcome, the mix temperature must be set above the dew point of the feed. The presence of polycyclic aromatics also affects cracking severity. Increasing the mix temperature to raise the riser temperature reverses the effect of polycyclic aromatics. In so doing, however, thermal cracking occurs, which is undesirable. To solve this problem it is necessary to be able to independently control the riser temperature relative to mix temperature. This problem is overcome in the present invention by the low partial pressure of the oil and the fact that the riser temperature is controlled by the injection rate of steam in the atomising nozzles, which is independent of the feed.

Mix temperature control (MTC) is achieved by injecting a suitable heavy-cycle oil stream into the riser above the oil feed injection point. This essentially separates the riser into two reaction zones. The first is between the feed injection and the cycle oil inlet. This zone is characterised by a high mix temperature, a high catalyst-to-oil ratio a very short contact time.

This is avoided according to the present invention since the heat transfer, vaporization and cracking takes place instantly in the riser and in the entrance of the cyclone.

As described earlier, it is highly desirable to achieve good catalyst/oil mixing as early and as quickly as possible in the process. The method described to achieve this requires the pre-acceleration and dilution of the catalyst stream. Traditionally, steam is the medium used to maintain catalyst bed fluidity and movement in the riser. Steam, however, has a deleterious effect on the very hot catalyst that is met in residue cracking processes. Under these conditions steam causes hydrothermal deactivation of the catalyst.

This is overcome in the present invention by using the off gases from the regenerator (CO/CO2) as the main carrier of the energy carrier.

Much work has been done in reducing the use of steam in contact with the hot catalyst. Some of the results of this work showed that if the partial pressure of steam is kept low, the hydrothermal effects are greatly reduced in the case of relatively metal free catalysts. A more important result of the work showed that light hydrocarbons impart favourable conditioning effects to the freshly regenerated catalyst. This was pronounced even in catalysts that were heavily contaminated with metals.

This one of the novel features by the present invention, namely that common mineral oxides may be used as energy carriers for oil with high metal and sulphur content.

Light hydrocarbon gases have been introduced in several heavy oil crackers since 1985. They have operated either with lift gas alone or mixed with steam. The limitations to the use of lift gas rests in the ability of downstream units to handle the additional gas.

This is also a novelty of the present invention, namely that we can handle the non-condensable gases in the down stream system. by using the off gases from the regenerator itself to carry the energy carrier, it is also possible to utilize the calorimetric heat in the gas, which reduces the energy consumption.

The cracked products leaving the FCCU reactor represent a wide range of cuts. This reactor effluent is often referred to as a 'syn'-crude because of its wide range of boiling point materials.

The 'syn'-crude assay should comprise at least a TBP (True Boiling Point) curve with an analysis of light ends, a gravity versus mid-boiling point curve and a PONA for the naphtha and sulphur content versus mid-boiling point for the 'syn'-crude.

The present invention relates to a FCCU cracking unit which aims at reducing a number of the obstacles associated with existing FCCU-units and, more specific, shows a FCCU-unit which can be built for small scale operation at a well site whereby heavy feedstock can be processed at the source. The advantage obtained is that feedstock with severe transport properties (pumping capability) can be converted into excellent transport conditions or be used as a diluent oil to be blended with the heavy crude. This kind of blending is used widely in for example Venezuela and Canada. A basic rule is that for every barrel of oil extracted from the reservoir, ¾ barrel of diluent oil is needed to blend the oil into good pump able conditions.

By using light diluent oil which may have a market price of $25-30 per barrel, the value of the oil is reduced to about $15 per barrel and thus a technology where one can produce diluent oil of heavy crude, will have a substantial economical potential.

The present process comprises the following main component:

1. A cyclone which is a part of the reactor system.
2. A fluidized catalyst regenerator with a cooling system.
3. A separation system consisting of one or more cyclones.
4. A condenser system.
5. A cooling system for the condensation.
6. A gas circulation system.
7. A preheating system for the feed.
8. An injection system of the feed with atomization nozzles.
9. A gas or oil combustor.

Below the process will be described in detail by reference to the enclosed drawings.

Referring to FIG. 1 the process is started by the combustion of oil or gas in a separate combustion chamber A), heating the catalyst B) in the regenerator C). The gas which consists of HC-gas, steam and CO and $CO_2$ is injected into a plenum D) and expands through perforated fluidising plate E) whereby the catalyst is transferred into a fluidised state and heated by the hot combustion gases.

The catalyst will be pneumatic conveyed through the raiser F) submersed into the fluidised bed.

Close to the exit of the riser, preheated oil is pumped through pipe G) to the atomizer nozzle H) where steam is injected through I) into the nozzle. The steam is generated by the heat exchanger J) in the regenerator. Excess steam is used to preheat the feed oil in the holding tank K) at about 100C.

The feed oil is charged by the pump L) via the heat-exchanger M) where it is preheated by the fluidising effluents leaving the regenerator C).

The oil which is atomised into microscopic droplets is heated by the catalytic particles whereby the temperature drops to set point above the dew point of the heaviest fractions. Because of the low partial pressure of the oil in the exhaust gases, it is possible to run the process at a temperature as low as 450 C.

The cracked oil gas together with the exhaust gases enters a "cracking" cyclone N) where the inlet area is made smaller than the area of the riser, thereby increasing the velocity of the gases. At the entry to the cyclone, the gases are bent about 45 deg, which reduces the speed of the gases and makes the flow subject to strong shearing forces participating in the cracking of the heaviest fractions of the oil.

In the cyclone N) the major part of the catalyst falls down to a cell feeder O) and returns back to the regenerator.

When coke is accumulated in the catalyst, the gas supply to the combustor A) is gradually reduced, whereby the coke in the catalyst is oxidized.

Makeup of lost catalyst is done from the storage hopper P)—either delivered by a screw conveyor or pneumatically. Spent catalyst is pneumatic removed from the regenerator through pipe AA) and separated out in the cyclone BB)

The gases leaving the "reactor" cyclone N) via Q) will thus consist of HC-gases, steam and CO, $CO_2$ and NOx and passes through a second cyclone R) where remaining catalyst is separated off. The gases are then transported to a condensing system consisting of a condenser S) and T) or a conventional distillation column. By the illustrated condenser system, the condenser S) condenses the HC-gases at a temperature of about 100 C whereby oil is discharged via U) to the receiver. The condenser can be of baffle-tray, scrubber or shell type. When using a scrubber or a baffle-tray condenser, recovered oil is used as condensing medium by which oil from the bottom of the condenser is pumped via an oil cooler V), which may be air or water cooled to the top of the condenser where it will mix with the gases from the reactor, condense, and these fall to the bottom of the condenser.

As the condenser is set to a temperature above the partial boiling-point of water, steam is passed to a steam-condenser T) which can be of shell type. By this arrangement, water is used as a condensing medium. The water containing the heat of condensation is transported to the heat exchanger J) where steam is produced as mentioned above. Water and lighter carried over fractions are discharged at the bottom of the condenser and passed to the receiver W) where oil is decanted off and pumped into the condenser S) where it is brought to the main stream of cracked oil. Non-condensable gases are vented at the top of the condenser and are either flared off or brought to a CO-boiler.

A thermodynamic cracking unit in accordance with the present disclosure, wherein the colliding particles in the riser of varying diameter leads to sonoluminescense caused by the fact that gas trapped in cavities on the particles and between these are exposed to adiabatic compression whereby temperature and pressure of the gas bubbles are increased and sonoluminescense is created by splitting of the molecules in the gas, which can be oil gas or steam, and emits light and by the fact that part of the oxygen radicals binds to the splitted oil molecules and thereby results in hydrogenation of the oil.

Because of the centrifugal forces on the catalysts in the "reactor" cyclone N, a far better action on the hydrocarbon is achieved than is known from other FCCU units.

Figure 2:
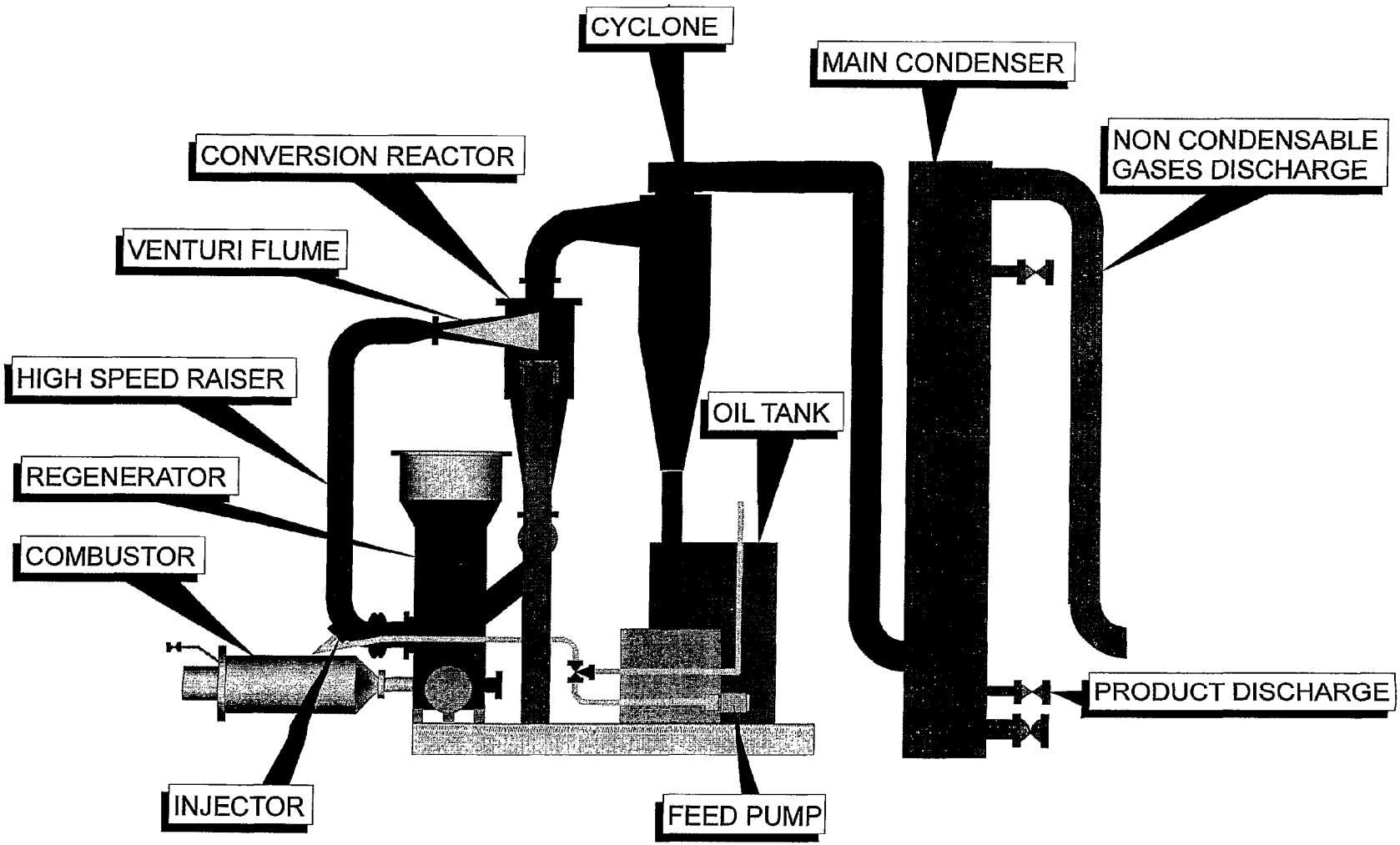
FIG. 2 shows one embodiment of a cracker unit according to the invention.

To have the principle of the invention tested, a rig was built as shown in the drawing FIG. 2, and is located at SINTEF ENERGY RESEARCH AS in Trondheim in Norway.

Several successful tests have been carried out on heavy crude from the oil field Melones in Venezuela with a gravity of 6.2 API. By a set temperature in the regenerator of 480° C. and a 97° C. of the feed oil and where fine grained olivine was used as a catalyst, the oil was cracked to a gravity of 21.5 API which clearly substantiate the principle of the invention.

By manipulating the temperatures, the output varied as expected without any cracking of the oil into gas.

The manipulation of the velocities in the riser, which is of crucial importance, was done by having different diameters of the riser. The diameter was increased 100% above the injection point of the feed and reduced before the entrance to the cyclone N).

Figure 3:
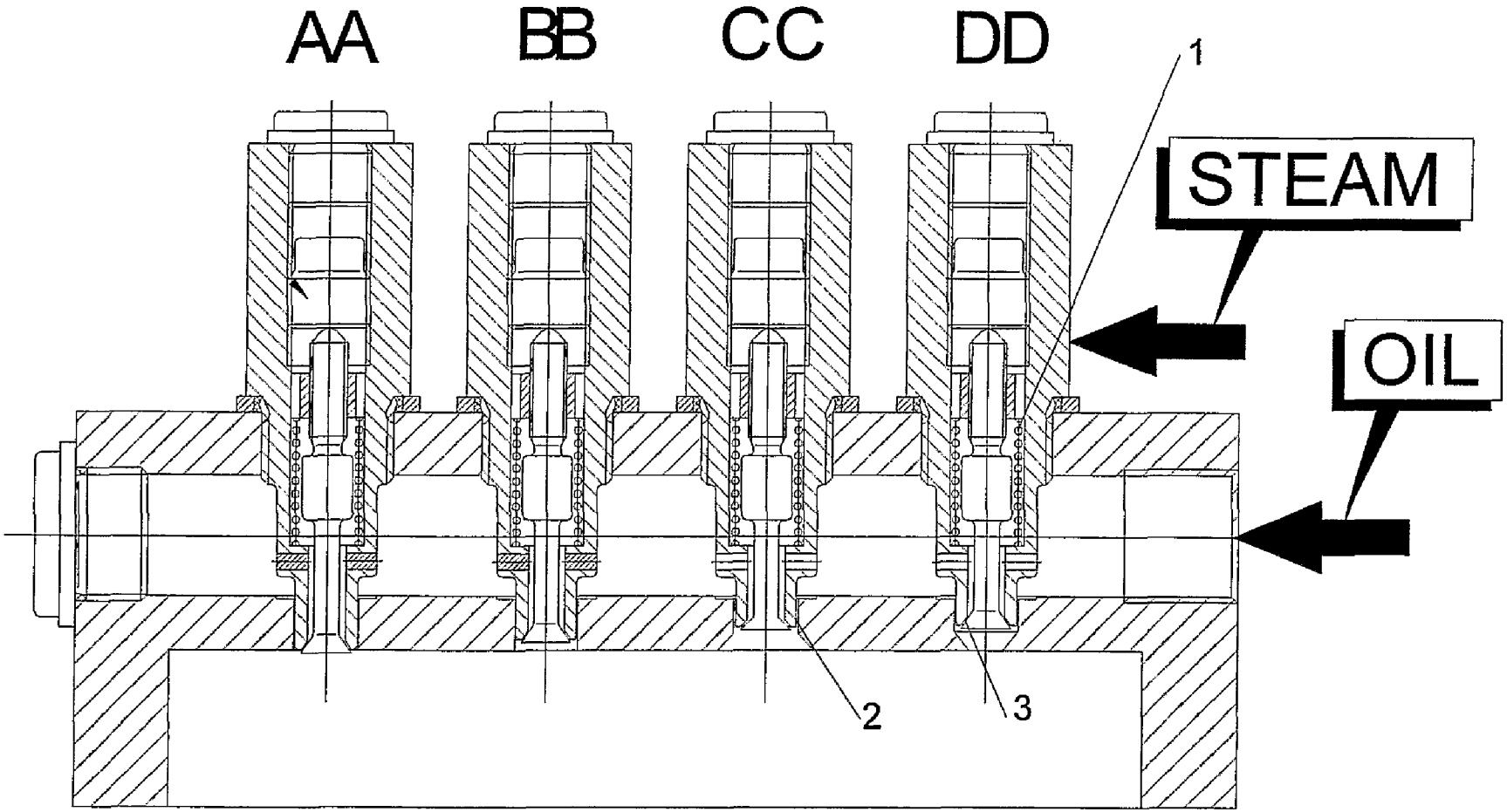
FIG. 3 shows one possible embodiment of the atomization nozzles of the cracker unit according to the invention.

The atomisation nozzles consist of two chambers, one for steam and one for oil. The layout of a possible nozzle is shown in FIG. 3 where 1) shows the spring setting the steam pressure, 2) shown the ring slot where the oil is injected and 3) the steam slot. AA, BB, CC and DD show different arrangements of the exit opening for the atomised oil and steam.

The invention claim is:

1. A cracking process, wherein cracking is carried out in a cyclone reactor and in a riser with varying diameter and with atomization nozzles under the influence of a rotating and turbulent fluidised energy carrier in the form of fine grained minerals, the fluidised energy carrier in the form of fine grained minerals are put in motion from a regenerator operated at a temperature of 450° C. to 600° C. through two exit lines with outlet under the level of a fluidized bed and are transported to the riser by combustion gases in a fluidization reactor wherein feed oil is preheated by the heat of condensation of the gases and that the oil is atomized in the atomization nozzles having a central inlet for steam, whereby the pressure is preset by springs and the oil in the surrounding chamber is passed to a ring slot where steam hits the oil film and breaks it up into droplets.

2. The cracking process in accordance with claim 1, wherein the energy carrier in the form of fine grained minerals is silica, magnesium oxide, aluminum oxide, copper oxide, anorthisite or olivine.

3. The cracking process in accordance with claim 1, wherein the reactor cyclone has an entrance which is diverting the flow of catalyst and gases whereby they will be subject to strong mechanical shear forces and where the catalyst may be evacuated from the reactor cyclone and be discharged to a regenerator via a rotating valve system and/or another closing device.

4. The cracking process in accordance with claim 1, wherein deactivated energy carrier is regenerated in a fluidised regeneration chamber having a fluidizing perforated plate above a plenum receiving either combustion gases or air and where the energy carrier is regenerated by oxidizing co-accumulated coke contained therein.

5. The cracking process in accordance with claim 4, wherein the fluidized regeneration chamber comprises a heat exchanger to control the temperature of the energy carrier in the reactor by steam generation in the heat exchanger.

6. The cracking process in accordance with claim 1, wherein regenerated energy carrier is transported pneumatically, through the riser by all, or a part of, the stream of combustion gases.

7. The cracking process in accordance with claim 4, wherein the coke which is oxidized on the energy carrier substantially supplies the energy for the operation of the process.

8. The cracking process in accordance with claim 1, wherein the combustion gases are passed to a suitable condensing system consisting of an oil- or steam condenser or a distillation column.

9. A cracking unit, comprising a cyclone reactor and a riser of varying diameter with atomization nozzles, having a central inlet for steam, whereby the pressure is preset by springs and the oil in the surrounding chamber is passed to a ring slot where steam hits the oil film and breaks it up into droplets, an inlet of the cyclone reactor is provided in the lower part of the reactor, in order to bring particulate energy carriers into an upward circulating movement with large shear and centrifugational forces, a perforated fluidizing plate situated approximately half a diameter from the bottom of the regenerator over a plenum for the regeneration of the particulate energy carrier, and a heat exchanger, provided in the fluidized bed of the particles in the regenerator, in order to control temperature.

10. The cracking unit in accordance with claim 9, wherein the varying diameter of the riser leads to acceleration and retardation of the stream of gas and particulate energy carriers leading to velocity variations between the gas and the particulate energy carriers and thereby an optimalization of the collisions between the particulate energy carriers and the oil drops injected in the riser and thereby optimalization of the energy transfer and mechanical collision forces between the particulate energy carriers and the oil droplets.

11. The cracking unit in accordance with claim 10, wherein the colliding particulate energy carriers in the riser of varying diameter leads to sonoluminiscense caused by the fact that gas trapped in cavities on the particles and between these are exposed to adiabatic compression whereby temperature and pressure of the gas bubbles are increased and sonoluminescense is created by splitting of the molecules in the gas, which can be oil gas or steam, and emits light and by the fact that part of the oxygen radicals binds to the splitted oil molecules and thereby results in hydrogenation of the oil.

12. The cracking process in accordance with claim 3, wherein the deactivated energy carrier is regenerated in a fluidised regeneration chamber having a fluidizing perforated plate above a plenum receiving either combustion gases or air and where the energy carrier is regenerated by oxidizing co-accumulated coke contained therein.

13. The cracking process in accordance with claim 3, wherein regenerated energy carrier is transported pneumatically, through the riser by all, or a part of, the stream of combustion gases.

14. The cracking process in accordance with claim 4, wherein regenerated energy carrier is transported pneumatically, through the riser by all, or a part of, the stream of combustion gases.

15. The cracking process in accordance with claim 5, wherein regenerated energy carrier is transported pneumatically, through the riser by all, or a part of, the stream of combustion gases.

16. The cracking process in accordance with claim 1, wherein regenerated energy carrier is transported without gravitational fall, through the riser by all, or a part of, the stream of combustion gases.

17. The cracking process in accordance with claim 3, wherein regenerated energy carrier is transported without gravitational fall, through the riser by all, or a part of, the stream of combustion gases.

18. The cracking process in accordance with claim 4, wherein regenerated energy carrier is transported without gravitational fall, through the riser by all, or a part of, the stream of combustion gases.

19. The cracking process in accordance with claim 5, wherein regenerated energy carrier is transported without gravitational fall , through the riser by all, or a part of, the stream of combustion gases.

* * * * *